US005799433A

United States Patent [19]

Danner et al.

[11] Patent Number: 5,799,433

[45] Date of Patent: Sep. 1, 1998

[54] ROUND SENSING MECHANISM

[75] Inventors: Dale R. Danner, Glendale; David S. Wolterman, Elizabethtown, both of Ky.

[73] Assignee: Remington Arms Company, Inc., Madison, N.C.

[21] Appl. No.: 736,188

[22] Filed: Oct. 24, 1996

Related U.S. Application Data

[63] Continuation-in-part of Ser. No. 680,490, Jul. 15, 1996.

[51] Int. Cl.[6] ..... F41A 9/53

[52] U.S. Cl. ..... 42/1.05; 42/84; 73/167

[58] Field of Search ..... 42/1.05, 1.01, 42/1.03, 84; 73/167; 89/28.05, 28.2, 6.5; 434/24

[56] References Cited

U.S. PATENT DOCUMENTS

| | | | |
|---|---|---|---|
| 3,250,034 | 5/1966 | Simmons | 42/84 |
| 3,255,547 | 6/1966 | Gregory, Jr. | 42/84 |
| 3,613,282 | 10/1971 | Ramsay | 42/84 |
| 3,650,174 | 3/1972 | Nelson . | |
| 3,814,017 | 6/1974 | Backstein et al. | 89/28.05 |
| 3,886,793 | 6/1975 | Cramer et al. | 73/167 |
| 4,324,060 | 4/1982 | Lawrence | 42/84 |
| 4,329,803 | 5/1982 | Johnson et al. . | |
| 4,332,098 | 6/1982 | Estenevy . | |
| 4,793,085 | 12/1988 | Surawski et al. . | |
| 5,329,940 | 7/1994 | Corney | 89/135 |
| 5,351,597 | 10/1994 | Holmstrom et al. | 89/6.5 |

*Primary Examiner*—Michael J. Carone
*Assistant Examiner*—Christopher K. Montgomery
*Attorney, Agent, or Firm*—Huntley & Associates

[57] ABSTRACT

A mechanism for determining the presence of a round of ammunition within a firearm by measuring the resistance across the round upon passing a test current through electrodes positioned to contact ammunition, and optionally means for determining the viability of the ammunition.

13 Claims, 5 Drawing Sheets

ROUND SENSING MECHANISM

CROSS REFERENCE TO RELATED APPLICATION

This is a Continuation-in-part of copending application Ser. No. 08/680,490, filed Jul. 15, 1996.

BACKGROUND OF THE INVENTION

This invention relates generally to a mechanism for determining the presence of a round of ammunition within a firearm and particularly to the use of such mechanisms in firearms for firing electrically activated ammunition.

There are many prior references to firearms for firing electrically activated ammunition. Particularly in such firearms, it would be desirable to have a means for sensing the presence of a round of ammunition in the firearm, and especially in the chamber, and particularly for determining whether such ammunition is viable. These capabilities would be of benefit to the user from at least the standpoints of power conservation in the firearm and reducing the possibility of attempting a shot when the ammunition is not capable of being fired.

SUMMARY OF THE INVENTION

The present invention provides a mechanism for determining the presence of a round of ammunition in a firearm. In addition, the mechanism of the present invention can optionally determine the viability of the round.

Specifically, the present invention provides, in a firearm comprising a barrel attached to a receiver, a chamber formed in the barrel adjacent to the receiver, the receiver being adapted to receive at least one round of ammunition, means for conveying the ammunition from the receiver into the chamber, a trigger assembly and a firing mechanism, the improvement comprising a mechanism for determining the presence of a round of ammunition within the firearm, the mechanism comprising at least one pair of electrodes positioned to contact electrically conductive portions of a round of ammunition within the firearm; means for supplying a predetermined current to at least one of the electrodes; means for measuring the resistance between the electrodes, and means for comparing the measured resistance with at least one reference.

Figure .4 is a cross sectional view in elevation showing one embodiment of a bolt assembly and trigger assembly of a firearm which can be used in conjunction with the present invention with the firing pin in its rearwardmost position.

Figures 4, 5, 6, 7:
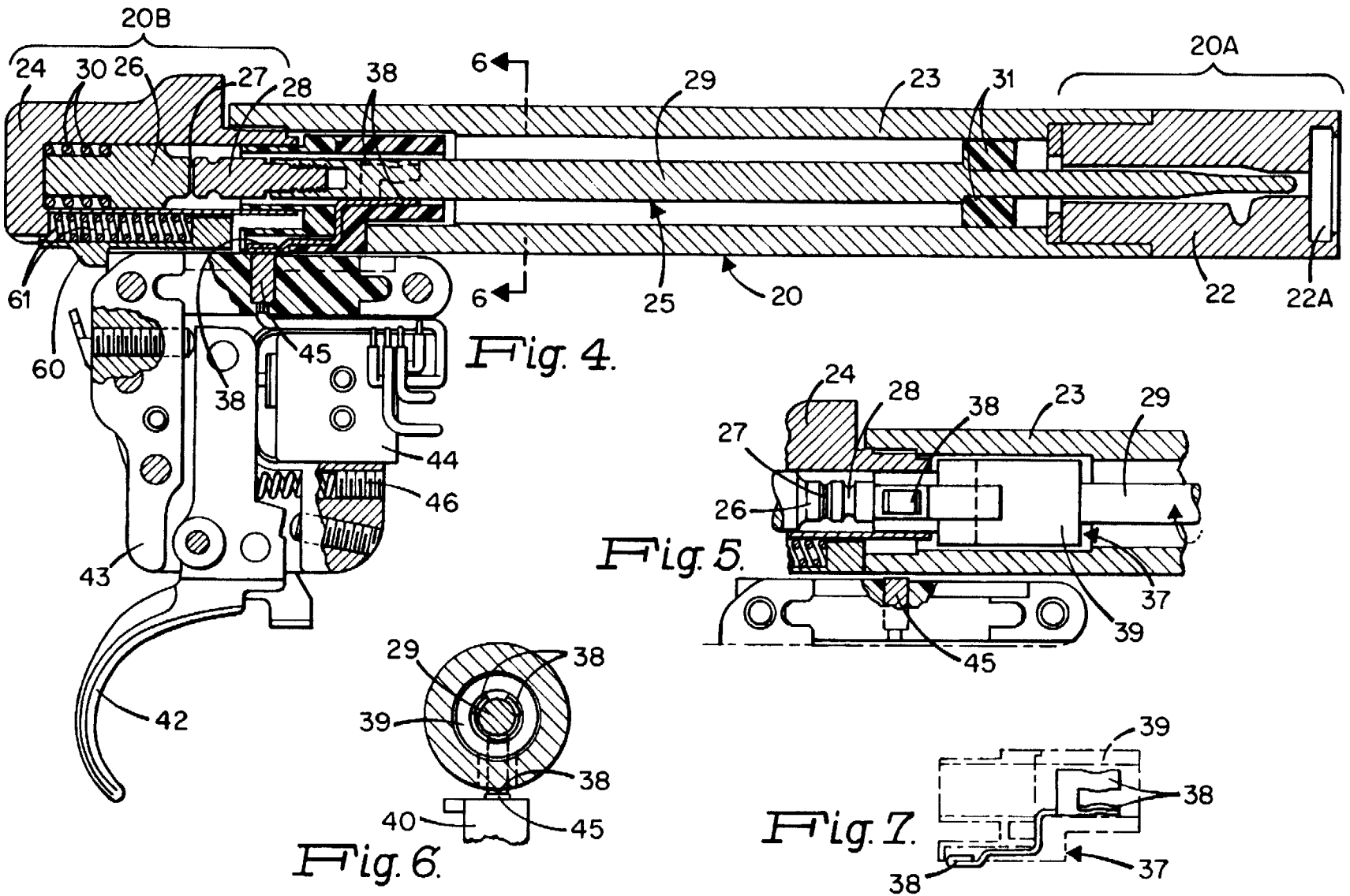

FIG. 5 is a fragmental side elevational view showing a portion of the bolt assembly as it is moved from the closed and locked position to the unlocked position.

FIG. 6 is a cross sectional rear elevational view taken along line 6—6 of FIG. 4.

FIG. 7 is a side elevational view of a firing pin electrical contact assembly, showing the contact housing in phantom.

Figure 8:
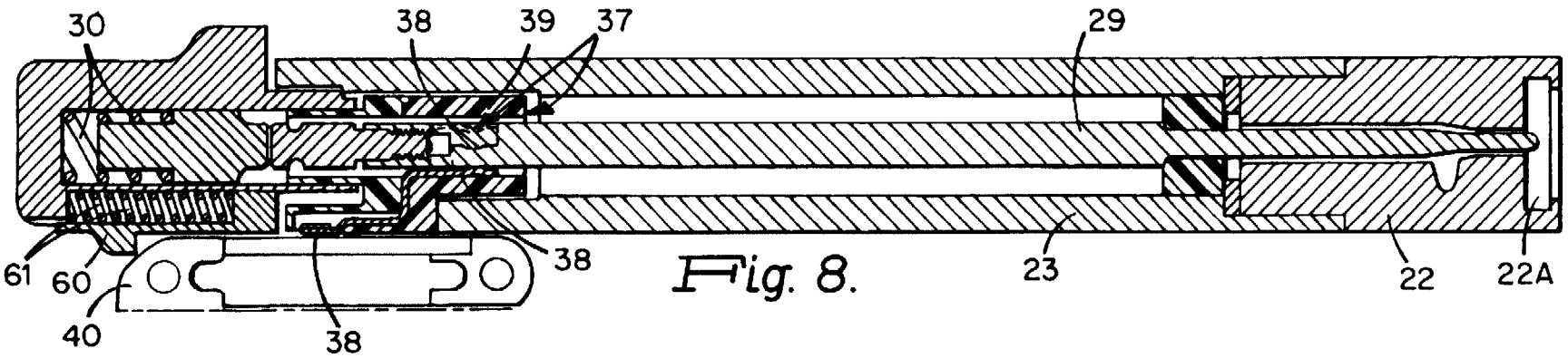

FIG. 8 is a cross sectional view in elevation showing the bolt assembly of FIG. 4 with the firing pin biased forward.

Figure 9:
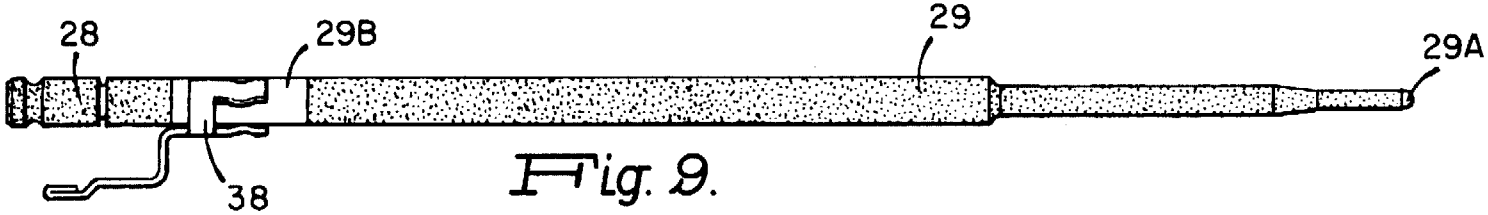
Figure 10:
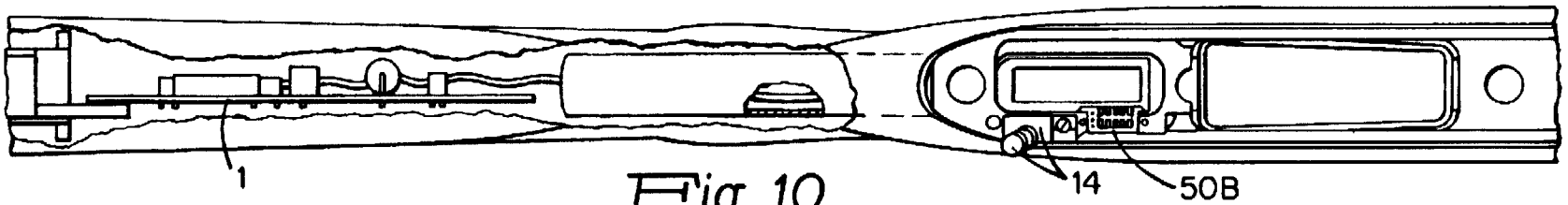

FIG. 9 is a side elevational view of a firing pin and firing pin electrical contact which can be used in conjunction with the present invention FIG. 10 is a fragmental top plan view of a firearm in which the present invention can be used, with the barrel assembly removed.

Figure 11:
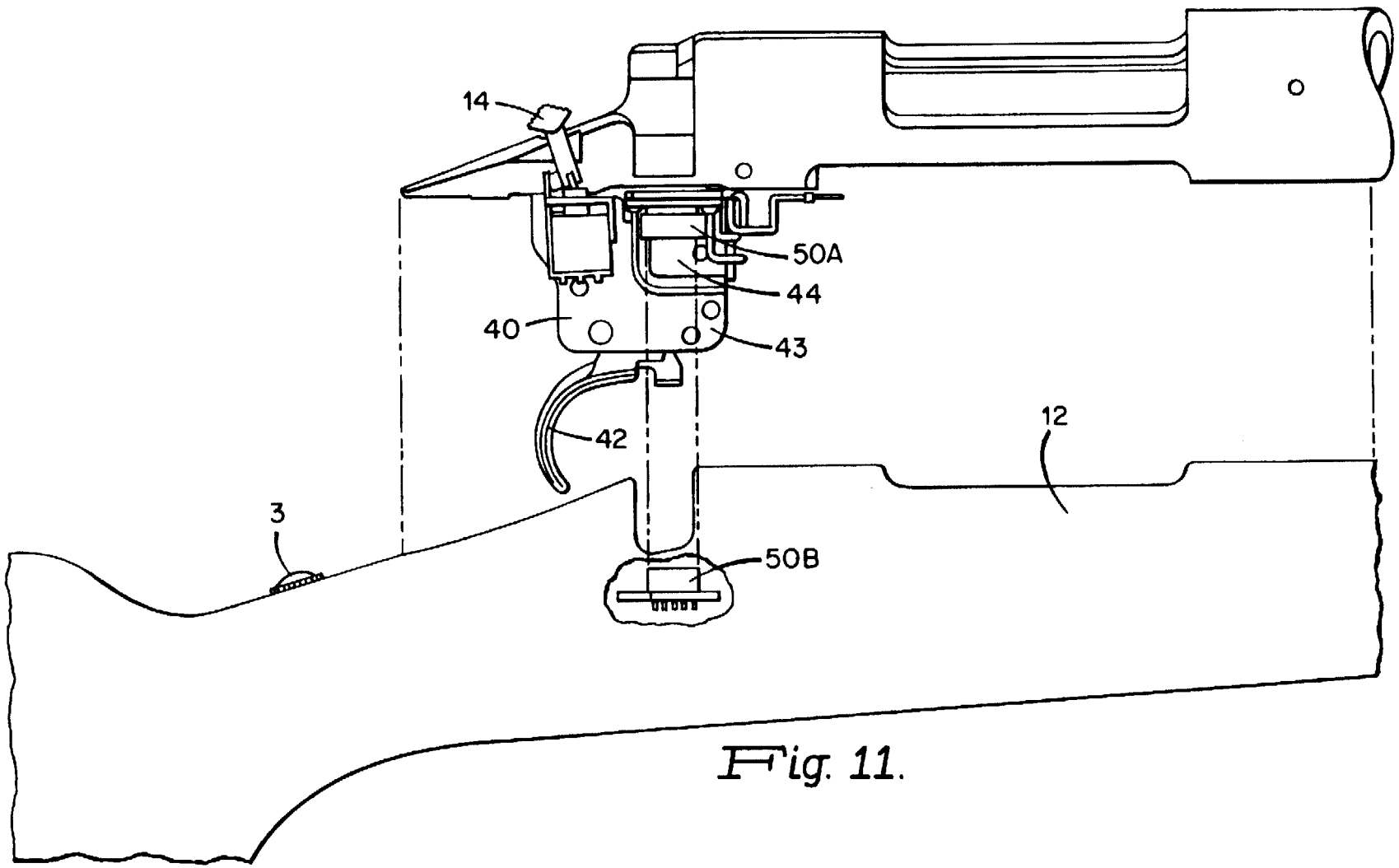

FIG. 11 is a fragmental exploded view of a firearm in which the present invention can be used.

Figures 12, 13A, 13B:
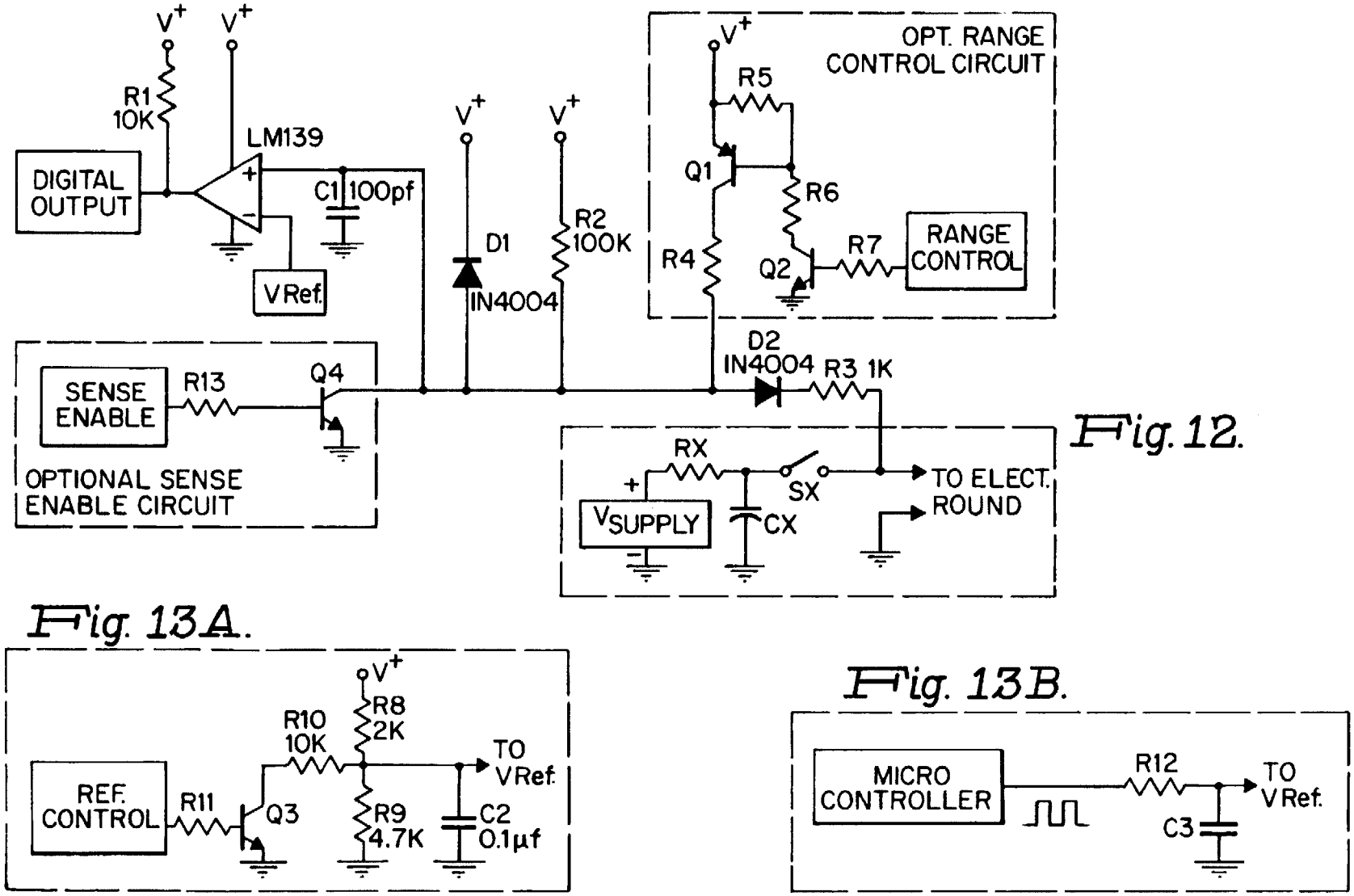

FIG. 12 is a schematic electrical diagram of a preferred embodiment of a mechanism of the present invention.

FIG. 13A is a preferred voltage reference control which can be used in the present invention.

FIG. 13B is an alternative voltage reference control which can be used in the present invention.

DETAILED DESCRIPTION OF THE INVENTION

The present invention provides a mechanism for detecting the presence of a round of ammunition within a firearm, and particularly for detecting ammunition which can be fired electrically, hereinafter designated electrically fired ammunition. Variation and modifications of the particular embodiments of the invention shown will be readily apparent to those skilled in the art.

The mechanism comprises a comparator circuit or other means for comparing levels of voltage and consequently determine resistance. The mechanism causes a small level of current to be transmitted through a circuit comprising the electrodes, the circuit being made by the contact between the electrodes and a round of ammunition within the firearm. If ammunition is present between the electrodes, the current will be transmitted from one electrode, which can be the firing pin, through the ammunition and into the second electrode, which can be the barrel of the firearm, which acts as a ground and completes the circuit. By comparing the level of resistance detected to an established reference, the mechanism can determine whether ammunition is present within the chamber, and, in alternate embodiments, can also determine whether the detected ammunition is viable.

The present invention is particularly well suited for use with electrically fired ammunition. Generally, ammunition adapted to be electrically fired includes an electrically conductive primer cap, and an electrically conductive primer mix contained in the primer cap. Alternate primer cap embodiments can include bridgewires, semiconductor bridges, and other forms apparent to those skilled in the art. The primer cap and primer mix together constitute the primer, which is also referred to herein as the electrically conductive portion of the electrically fired ammunition. The primer mix is electrically activated, and the activation of the mix causes the ammunition to be fired. Some primers, due to having a potentially narrow band of acceptability, may require a complex form of AC impedance measurement to make the required viability determinations. Those skilled in the art will recognize the adaptability of the preferred embodiments of the present mechanism to deal with both the real and imaginary (capacitive or inductive) components which form the complex impedance. Accordingly, for simplicity, as used herein, the term "resistance" refers generically to the DC steady state resistance or the AC impedance.

The present invention will be more fully understood by reference to the Figures. In the electrical diagrams shown in FIGS. 12, 13A and 13B, switches are generally identified by the designation "Q," resistors are generally identified by the designation "R," and capacitors are generally identified by the designation "C." The switches "Q" are preferably low $V_{CEsat}$ Bipolar Transistors or low $R_{DSON}$ Field Effect Transistors.

According to the present invention, a small predetermined level of current is passed through ammunition within a firearm, allowing a measurement to be made of the resistance of the circuit formed by the ammunition and the electrodes. The electrodes are preferably located in the chamber of the barrel, so that the ammunition can be tested when it is in the ready-to-fire position. The remainder of the components of the round sensing mechanism are conveniently located in the stock of the firearm. In alternate embodiments, it may be desirable to have the electrodes in other locations, such as the magazine or receiver. The resistance of the ammunition can be examined by comparing the resultant voltage (which is a function of the ammunition resistance) to a supplied reference voltage, by the use of a comparator. If no round is present, the circuit is open and the resistance is high.

The predetermined level of current to be passed through the ammunition is selected or determined according to, inter alia, the type and caliber of ammunition being used in the firearm. Typically, for electrically fired ammunition, the level of current should be less than about half of that needed to initiate the primer. Preferably, the level is at least about two orders of magnitude below the level required to activate the primer and cause the ammunition to be fired, measured under the least favorable conditions.

The voltage is supplied to one of the electrodes positioned to contact the ammunition. With electrically fired ammunition, the point of contact is most desirably the electrically conductive primer, within the chamber. The electrode can be, in those embodiments, the firing pin of the firearm, which is typically positioned to contact the primer cap when the firearm is ready to be fired. The other electrode typically goes to ground and can be located in the barrel of the firearm.

With reference to the figures, and particularly FIGS. 12, 13A and 13B, the current passed through the round is supplied through R2. Optionally, additional current can be supplied via the switched network of R4–R7, Q1, and Q2. This allows for the detection of a broader range of levels of resistance in the primer, in particularly very low resistance values including values which are at or near zero and may be enabled or disabled through the range control input.

The particular embodiment illustrated in the Figures is based on the assumption that the ammunition in the chamber is ground referenced. In other words, the primer cap typically has two electrical contacts, one of which is tied to ground. Other embodiments within the scope of the present invention include those in which neither of the contacts are ground referenced. The specific circuitry for such variations can be readily adapted from the present diagrams by those skilled in the art.

Basically, electric primers are initiated by passing a current through the primer sufficient for initiation. With reference to FIGS. 12, 13A and 13B, a test circuit can consist of V supply, Cx, Rx, and switch Sx. By closing switch Sx, an initiation current level is transmitted to the primer. In those embodiments in which a system control means is present, the switch can be incorporated into the trigger mechanism. Alternatively, the switch can be independent of the trigger mechanism.

Diode D2 serves to stop current flow from this initiation into the round sensing circuit. Additional and optional protection for the circuit can be provided by diode D1 which clamps peak voltage to a V+rail, further isolating the round sensing circuit from the initiation current pulse. Resistor R3 serves to prevent uncontrolled current from initiating the primer due to a failure in the round sensing circuit. It is conceivable that should the comparator fail internally V+ voltage levels may appear at the "+" terminal. Resistor R3 limits such current to an acceptable level such to prevent inadvertent initiation of the primer.

The means for comparing the resistance between the electrodes can vary widely, and can be selected from a variety of known comparator circuits or apparatus. Analog comparators are preferably used. An analog comparator is a device which is commonly used to interface with or condition analog signals to a digital signal or display. In the digital environment, levels correspond generally to a "high" or logic one level and to a "low" or logic zero level. Dealing with levels between these two states or with levels which are at incompatible absolute voltages is easily done with comparators. Fundamentally, analog voltages are applied to the "+" and "–" inputs on the comparator and the output of the comparator reflects the state established by these applied voltages. The output becomes a logic one if the analog voltage applied to the "+" input is greater than that applied to the "–" input. The output becomes a logic zero if the voltage applied to the "+" input is less than that applied to the "–" input.

The comparator shown in the Figures is one section of a common LM139 quad analog comparator integrated circuit. Other commercially available comparators which can be used will be readily apparent to those skilled in the art.

By supplying a predetermined level of voltage to the "–" input of the comparator, a determination of whether the "+" input is above or below that level can be made by examining the digital output of the comparator.

The generation circuit for the reference voltage used in the circuit can vary widely. Two possible embodiments are illustrated in FIG. 13A and 13B. FIG. 13A shows a preferred embodiment which is a simple resistance ladder with a transistor switch to optionally add another resistor to the network. This network comprises R8–R11, C2, and Q3. The reference voltage is derived from a regulated supply V+, which in this embodiment is +5V. Other V+ voltages can be utilized by adjusting the resistor divide ratio (R8, R9, and R10) using techniques common to one skilled in the art. By controlling Q3 via a microcontroller or other means through Reference Control two selectable reference voltages are generated. In this embodiment R8=2K, R9=4.7K, and R10=10K ohms. Given V+ is a regulated +5V, this circuit will produce a reference voltage of 3.51 volts with the Q3 switch off, and 3.08 volts with the Q3 switch on. Capacitor C2 serves to eliminate any ripple component present on V+ and may be optional, dependent on the supply quality of V+.

An alternate embodiment of the reference voltage generating means is shown FIG. 13B. This embodiment assumes the use of a microcontroller or other logic control device in the overall apparatus. The reference voltage can be generated by varying the duty cycle of an AC square wave produced by the microcontroller and filtered by R12 and C3. This is common practice by those skilled in the art to inexpensively generate a variable voltage which would be completely under software control.

The sense voltage generated at comparator input "+" is from the resistive voltage divider network R2, R3, D2 and the electric primer itself. The voltage present at the "+" terminal of the comparator is given by the following equation:

$$\text{Comp. "+"Voltage}=[(V+*\ R3)+(V+*\ Rround)+(V_{D2}*R2)]/\ (R2+R3+Rround)$$

where V+is the regulated supply voltage. $V_{D2}$=the voltage drop across diode D2 and Rround is the impedance of the round in question.

In the preferred embodiment R2=100K and R3=1K ohms. V+is a regulated supply of 5 volts. $V_{D2}$ is 0.5 volts. Hence the equation reduces to:

$$\text{Comp. "+"Voltage}=[V+*(1000+\text{Rround})+(V_{D2}*100000)]/(101000+\text{Rround}).$$

Noting from above the two generated reference voltages of 3.51 volts and 3.08 volts, assuming V+=5.0 volts and $V_{D2}$=0.5 volts, and substituting these voltages into the above equation for the Comp. "+" Voltage the impedance of the primers which will match these thresholds are:

Reference Voltage of 3.51V→Yields a primer resistance of 201013 ohms or approximately 200K Reference Voltage of 3.08V→Yields a primer resistance of 133375 ohms or approximately 130K As will be evident by the illustration above, by selectively controlling the Reference Control input to select different reference voltages it can be determined:

a) whether a primer of impedance less than 200 K ohms is present at the primer contacts, and b) whether a primer of impedance greater than 130 K ohms is present at the primer contacts. Based on these conditions, an assessment can be made of the viability of the primer. If both conditions are true, the primer is determined to be viable or valid. If either or both are false, the primer either is not present or falls outside the range of acceptability.

In an alternate, and somewhat simpler, embodiment of the invention, the dual reference design can be omitted and only one reference used. This simplifies the design but only one resistance determination can be made. By careful selection of component values, the circuit can be used simply as a round present indicator such that if a logic one level is detected at the comparator output the primer is not present. Conversely, if a logic zero is detected at the comparator output, the primer is present. By not verifying the low threshold impedance as done in the preferred embodiment it cannot be determined if the primer is viable, and, in fact may be shorted.

A further preferred embodiment of the invention schematically illustrated in FIG. 12 is the Sense Enable Circuit made up of R13 and Q4. Should the need to disable or stop the sense current flow through the primer be required, switch Q4 can be turned on. This will shunt the current provided through R2 through the Q4 enable switch, effectively turning off round sensing current to the primer.

Figure 1:
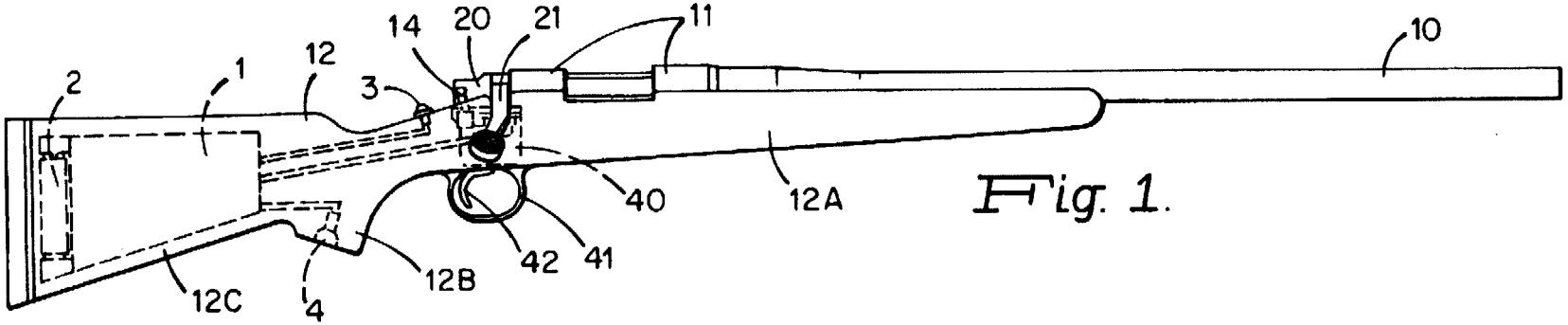
FIG. 1 is a side elevational view of a firearm in which the mechanism of the present invention can be used.
Figure 2:
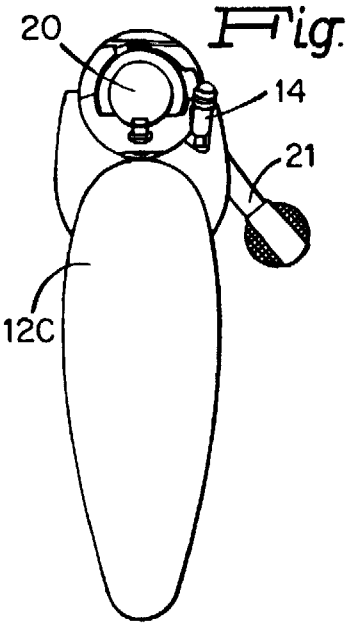
FIG. 2 is a rear elevational view of the firearm of FIG. 1.

The round sensing mechanism of the present invention can be used to particular advantage in an electronic firearm for electrically fired ammunition having a system control means. Such an electronic firearm is illustrated in FIGS. 1 through 11, in which a firearm has a barrel 10 which is attached to receiver 11, and a stock 12. The stock consists of a forearm 12A at a forward portion thereof, a pistol grip 12B at a middle portion, and a butt 12C at a rearward portion thereof Both the barrel and receiver are encased in the forearm 12A of the stock 12. The barrel has a chamber formed in its rear end where it is attached to the receiver. The chamber is connected and adapted to receive ammunition from the receiver. A bolt assembly, generally indicated as 20, is movably positioned within the receiver, behind and substantially aligned with the barrel, and has a handle 21. The barrel 10, receiver 11, bolt assembly 20, and trigger assembly 40 comprise the barrel assembly of the firearm. A safety switch 14, is shown behind the bolt assembly, which is shown in FIGS. 1 and 2 in a closed and locked position.

The firearm, as illustrated, has a system control means 1, which in the embodiment shown is in the butt of the stock. The firearm further comprises a voltage supply means 2, shown in the butt of the stock. The voltage supply means, which in the embodiment shown is a battery, provides power to and is operatively connected to the system control means. In the Figures, the firearm has an electronic safety 14, an LED indicator 3, and a system authorization switch 4 for controlling access to the firearm. The selection and positioning of the LED indicator can vary widely, according to the design parameters of the particular firearm. In the embodiment discussed above, at least one visual LED indicator is positioned on the stock of the firearm directly behind the receiver. Similarly, the selection and positioning of the system authorization switch can vary widely, but in the embodiment of the firearm shown, the system authorization switch is key activated and located on the bottom portion of the pistol grip of the stock.

Figure 3:
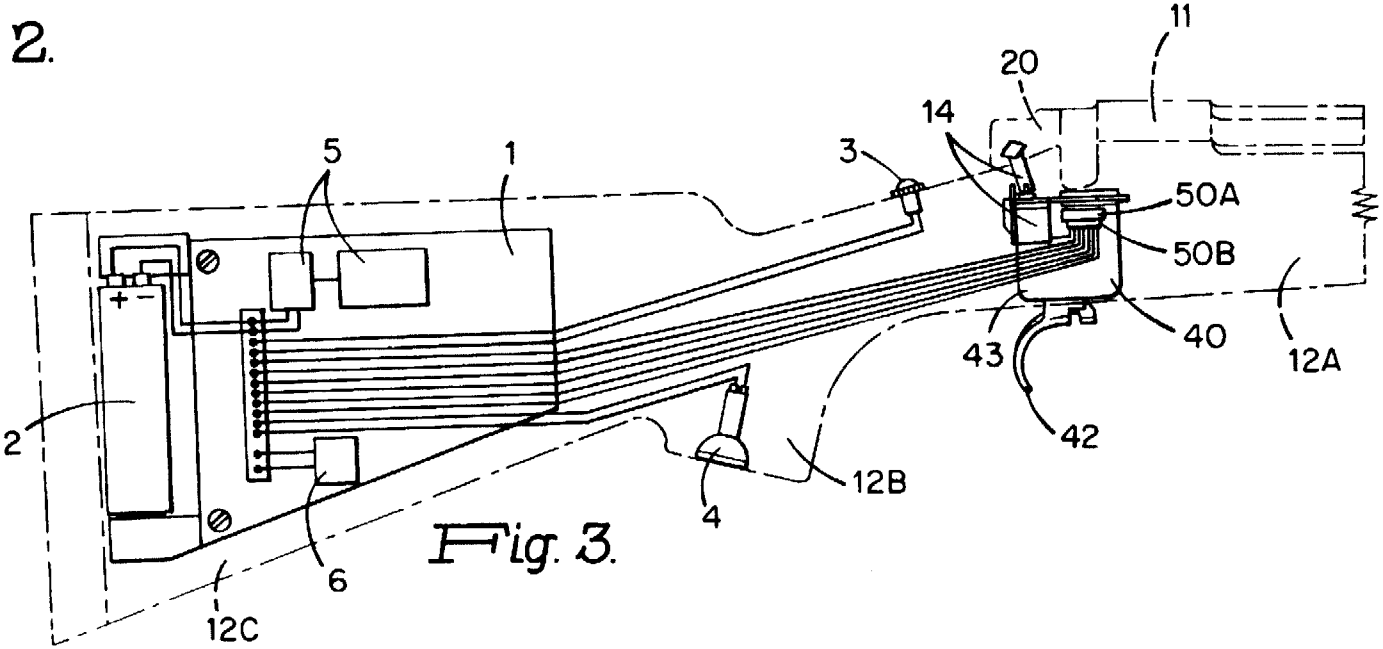
FIG. 3 is a wiring diagram of one embodiment of a firearm which can be used in conjunction with the present invention.

FIG. 3 is a wiring diagram showing the voltage supply means 2, the preferred system control 1, system authorization switch 4, LED indicator 3, and electronic safety switch 14 as they are wired together. In addition, FIG. 3 shows a blind mate circuitry connection having one connector 50A mounted to the trigger assembly 40 and a reciprocal mating connector 50B mounted into the forearm of the stock and attached to wires from the system control means. The reciprocal connector mounted in the stock is positioned to mate with the other connector when the barrel assembly is installed in the firearm. When the reciprocal connector is mated with the other connector, a connection is provided whereby the electronic safety switch and the trigger assembly are connected to the system control means.

The system control means shown comprises voltage increasing means 5 and the preferred means for detecting the presence of a round of ammunition 6 within the chamber. The embodiment of the voltage increasing means shown comprises a boost converter to increase the voltage from the battery to the level necessary to initiate the ammunition, for example, from 9 volts, if a battery of that voltage is used as the power source, to a voltage sufficient to initiate the electrically primed ammunition. The voltage increasing means typically comprises inductors, diodes, capacitors and switches, the arrangement of which is dependent on the specific boost converter used. Other embodiments may use converters other than the boost topology. Variations and modifications of these embodiments can be substituted without departing from the principles of the invention, as will be evident to those skilled in the art.

FIG. 11 is a fragmental exploded view of the firearm showing the barrel assembly removed from the stock 12, and FIG. 10 is a fragmental top plan view of the firearm with the barrel assembly removed. By removing the barrel assembly, a blind mate connection comprising two blind mate connectors, 50A, and 50B, is broken, and is easily made when the barrel assembly is replaced in the stock.

In the Figures, the bolt assembly 20 has front 20A and rear 20B ends and a bolt head 22 comprising a bolt face 22A at the front end. The bolt assembly can move longitudinally and rotationally within the receiver. More specifically, the bolt assembly can be moved among opened, closed, and closed and locked positions. When the bolt assembly is closed the bolt face is positioned within the rear of the chamber of the barrel. At the rear end 20B of the bolt assembly there is a handle 21 for moving the bolt to its alternate open, closed, and closed and locked positions. A trigger assembly 40 located below the receiver and within the forearm of the stock has a trigger guard 41 which extends below and beyond the forearm, and within the trigger guard is a trigger 42. The trigger assembly, shown in FIGS. 4 and 11, is discussed in detail below.

The bolt assembly is positioned within the receiver behind and substantially aligned with the barrel. As shown in the Figures, the bolt assembly includes a hollow bolt body 23 operatively connected at its rear end to a hollow bolt plug 24 which is sealed at its rear end, and a handle 21 on the rear of the bolt assembly which acts as a lever for moving the bolt assembly within the receiver. A movable firing pin assembly 25 is positioned within the bolt assembly and consists of a firing pin plunger 26, a firing pin plunger insulator 27, a firing pin plug 28, and the firing pin itself 29. The firing pin plunger is operatively connected at its forward end to the firing pin plug, and the firing pin plug is operatively connected at its forward end to the firing pin within the bolt body. The firing pin plunger insulator is positioned between the firing pin plunger and the firing pin plug. The firing pin plunger insulator can be a separate component attached to the forward end of the firing pin plunger, or it can comprise an insulating treatment to the forward end of the firing pin plunger.

A firing pin spring 30, positioned between the sealed rear end of the bolt plug and the firing pin plunger, biases the firing pin forward by acting on the firing pin plunger. A firing pin shoulder 31 within the front end of the bolt body is positioned to restrict the forward movement of the firing pin, and the rearward movement of the firing pin is limited by the plunger contacting the rear of the bolt plug. FIG. 4 shows the firing pin assembly in its rearwardmost position, while FIG. 8 shows the firing pin assembly biased forward to contact a round of ammunition within the chamber of the barrel.

The firing pin plunger, firing pin plunger insulator, firing pin plug, and the firing pin are operatively connected to form the firing pin assembly. In alternate embodiments, the firing pin shoulder can be connected to the firing pin and a part of the firing pin assembly, or it can be positioned within the bolt body. The firing pin assembly is moveable within the bolt assembly, but its movement is restricted. Specifically, the firing pin shoulder within the front end of the bolt body is positioned to restrict the forward movement of the firing pin assembly by limiting the forward movement of the firing pin, and the rearward movement of the firing pin assembly is limited by the rear of the firing pin plunger contacting the rear of the bolt plug.

The movable firing pin assembly, biased forward by firing pin spring 30, ensures contact between the forward conductive tip of the firing pin and the primer cap at the rear of a round of ammunition within the chamber when the bolt assembly is closed and locked by permitting the firing pin assembly to position itself to compensate for manufacturing variations in ammunition. Rearward travel of the firing pin is limited to provide support for the electric primer during firing.

In addition, the firing pin plug and the firing pin are adapted to be adjustably connected, permitting individual adjustment of the firing pin in relation to the firing pin plug so that the forward tip of the firing pin is adjustable with respect to the bolt face when the firing pin is biased into its rearwardmost position, thus supporting the primer cap in the ammunition during firing and preventing the firing pin from becoming lodged within the bolt body when it is forced rearward by the ignition of a round of ammunition within the chamber, as shown in FIG. 4.

In an alternate embodiment of the firing pin assembly not here shown, the firing pin plug is a threaded adjustment screw, and the bolt plug has a threaded aperture formed in its rear end adapted to receive the adjustment screw. The firing pin spring in the bolt plug biases the firing pin assembly forward by acting on the bolt plug and the firing pin plunger. The adjustment screw contacts the rear of the firing pin plunger to restrict the rearward motion of the firing pin assembly, and can be set so that the forward tip of the firing pin is adjustable with respect to the bolt face when the firing pin is in its rearwardmost position. As in the embodiment of the firing pin assembly shown in FIGS. 4 through 8, the firing pin is biased forward to compensate for dimensional variations in ammunition to assure that the firing pin will be positioned to contact a round of ammunition within the chamber.

Like the firing pin assembly, the bolt assembly is movably mounted within the receiver of the firearm, and its movement is also limited. On the forward end of the bolt assembly, the bolt head 22 is operatively connected to the front end of the bolt body and has lugs (not shown) positioned to engage slots (also not shown) formed in the front of the receiver. The slots extend from the rear to the front of the receiver. The engagement between the lugs and the slots guides the bolt assembly, and defines its positions as opened, closed or closed and locked. In addition, when the bolt assembly is closed and locked, the engagement between the lugs and the slots prevents rearward motion of the locked bolt assembly.

The forward motion of the bolt assembly is also restricted when it is in the closed and locked position by a bolt plug detent 60 on the bottom of the bolt plug. The bolt plug detent is biased forward by a bolt plug detent spring 61. The bolt plug detent further restricts the forward movement of the bolt assembly by contacting the trigger housing when the bolt assembly is closed, and restricts forward motion when the bolt is locked. The contact between the bolt plug detent and the trigger housing secures the bolt assembly by restricting forward motion of the bolt assembly when it is in the locked position, and the engagement between the lugs and the slots further secures the bolt assembly by preventing rearward motion of the bolt assembly when it is locked.

In the embodiment of the bolt assembly shown in FIGS. 4 through 8, a firing pin contact assembly 37 consists of an electrical contact 38 and an insulating housing 39 fixed within the rear of the bolt assembly to rotate and move with the bolt assembly. The firing pin contact is positioned to connect the conductive area at the rear of the firing pin, or, in the alternate embodiment discussed above but not shown, to connect the conductive area at the rear of the firing pin assembly, with an electrical contact on the trigger assembly. The circuit between the firing pin contact and the electrical contact on the trigger assembly can only be completed when the bolt assembly is closed and locked. The firing pin contact and the conductive area at the rear of the firing pin remain connected when the bolt is locked, even as the firing pin is biased forward by the firing pin spring and rearward by a round of ammunition within the chamber of the barrel, thus allowing for dimensional variations in individual rounds of ammunition and ensuring electrical contact between the firing pin and the firing pin contact despite those variations. In addition, the movably mounted bolt assembly ensures that an electrical connection cannot be made between the firing pin and the trigger assembly electrical contact unless the bolt is in the closed and locked position, thus augmenting the system control. In an alternate embodiment of the invention, the contact point can be the firing pin plug, which then transmits the current to the ammunition in the chamber.

In FIGS. 4 through 8, the firing pin assembly is provided with electrical isolation means to insulate the body of the firing pin, and in the alternate embodiment discussed above, to insulate the body of the firing pin and the firing pin plug. FIG. 9 shows on embodiment of the firing pin provided with the electrical isolation means. The electrical isolation means does not insulate the firing pin at a forward conductive end 29A and rearward conductive area 29B. The forward conductive end is positioned to transmit voltage to a round of ammunition within the chamber of the barrel only when the bolt assembly is in a closed and locked position, and the rearward conductive area is positioned to receive voltage only when the bolt assembly is in the closed and locked position. Within these parameters, the electrical isolation means can vary widely, and can comprise an electrically insulating sleeve around appropriate portions of the firing pin, a surface coating on the firing pin, or a surface modification of the firing pin. Coating materials which can be used for the firing pin include, for example, polymers applied preformed or in site. Amorphous diamond or ceramics can also be used for an insulating coating on the firing pin. Of the many known ceramics that can be used, those found to be particularly satisfactory include alumina and magnesia stabilized zirconia. Surface modification of the firing pin can also include, for example, ion implantation. Still other coatings or treatments for the firing pin will be evident to those skilled in the art.

The trigger assembly comprises a trigger housing 43 which houses a trigger 42 operatively connected to a microswitch 44, and a trigger assembly contact 45. The trigger assembly contact is positioned to contact the firing pin contact at the rear end of the bolt assembly, only when the bolt assembly is in the closed and locked position. When the bolt assembly is in the closed and locked position, the trigger assembly contact and the firing pin contact are aligned to form a closed circuit, however, the system control will only permit power to be transmitted from the voltage increasing means through the trigger assembly contact, the firing pin contact, the firing pin, and to a round of ammunition as described in detail above.

The present invention permits electrically determining whether a round having an electrically activatable primer is present in a firearm, and particularly in the chamber of a firearm. Once detected, it can determine the viability of the round. After such determination, this information can be monitored with a microcontroller or other logic to provide feedback to the user as to the current firearm status. This feedback may take the form of a visual or audio indicator. It will also be evident to those skilled in the art that the information concerning round presence can be used to enhance the safety of the firearm through user feedback or to allow the firearm to conserve power under the condition of no round present. This can be done through the preferred system control means described above.

We claim:

1. In a firearm comprising a barrel attached to a receiver, a chamber formed in the barrel adjacent to the receiver, the receiver being adapted to receive at least one round of ammunition, means for conveying the ammunition from the receiver into the chamber, a trigger assembly and a firing mechanism, the improvement comprising a mechanism for determining the presence of a round of ammunition within the firearm, the mechanism comprising at least one pair of electrodes positioned to contact electrically conductive portions of a round of ammunition within the firearm; means for supplying a predetermined current to at least one of the electrodes; means for measuring the resistance between the electrodes, and means for comparing the measured resistance with at least one reference.

2. A mechanism of claim 1 in which the electrodes are positioned in the chamber of the firearm.

3. A mechanism of claim 1 adapted to determine the presence of electrically fired ammunition.

4. A mechanism of claim 3 wherein at least one of the electrodes is an electrically conductive firing pin positioned to contact an electrically conductive portion of a round of ammunition within the chamber.

5. A mechanism of claim 4 wherein the firing pin is moveably mounted within a moveable bolt assembly, and the firing pin is positioned to contact the ammunition only when the bolt assembly is in a closed and locked position.

6. A mechanism of claim 4 wherein the firing pin is positioned to contact an electrically conductive primer of the ammunition within the chamber.

7. A mechanism of claim 3 wherein the predetermined current is less than about half of that needed to fire the ammunition.

8. A mechanism of claim 7 wherein the predetermined current is less than the current needed to fire the ammunition by at least two orders of magnitude.

9. A mechanism of claim 1 wherein the means for comparing the measured resistance is an analog comparator.

10. A mechanism of claim 1 wherein the means for supplying the predetermined voltage comprises a resistance ladder for regulation of the voltage.

11. A mechanism of claim 1 further comprising a second circuit adapted to disable the means for supplying the predetermined current.

12. A mechanism of claim 1 further comprising means for indicating the presence of a round of ammunition within the chamber of a firearm.

13. A mechanism of claim 3 further comprising means for indicating the viability of a round of ammunition within the firearm.

* * * * *